US011454074B2

(12) United States Patent
Kellner et al.

(10) Patent No.: US 11,454,074 B2
(45) Date of Patent: Sep. 27, 2022

(54) BACK PRESSURE VALVE

(71) Applicant: INNOVEX DOWNHOLE SOLUTIONS, INC., Houston, TX (US)

(72) Inventors: Justin Kellner, Adkins, TX (US); Jason Voss, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 17/113,262

(22) Filed: Dec. 7, 2020

(65) Prior Publication Data

US 2021/0172274 A1 Jun. 10, 2021

Related U.S. Application Data

(60) Provisional application No. 62/944,431, filed on Dec. 6, 2019.

(51) Int. Cl.

| | |
|---|---|
| ***E21B 21/10*** | (2006.01) |
| ***E21B 34/14*** | (2006.01) |
| ***E21B 34/10*** | (2006.01) |

(52) U.S. Cl.

CPC ..... *E21B 21/10* (2013.01); *E21B 34/14* (2013.01); *E21B 34/10* (2013.01); *E21B 2200/05* (2020.05)

(58) Field of Classification Search

CPC ..... E21B 21/10; E21B 34/14; E21B 34/10; E21B 2200/05; E21B 34/142

See application file for complete search history.

(56) References Cited

U.S. PATENT DOCUMENTS

| | | | | |
|---|---|---|---|---|
| 7,673,689 | B2 | 3/2010 | Jackson et al. | |
| 8,215,403 | B1 * | 7/2012 | Penisson | E21B 23/006 166/331 |
| 11,066,894 | B2 * | 7/2021 | Stone | E21B 34/10 |
| 11,066,909 | B2 * | 7/2021 | Yin | E21B 34/103 |
| 2016/0090816 | A1 * | 3/2016 | Gosselin | E21B 33/14 166/332.1 |

* cited by examiner

*Primary Examiner* — Michael R Wills, III

(74) *Attorney, Agent, or Firm* — MH2 Technology Law Group LLP

(57) ABSTRACT

A valve assembly for use in a wellbore includes a housing defining a bore that extends axially therethrough, a valve seat positioned in the housing, and a valve element movably positioned in the housing. The valve seat and the valve element are concentric to one another, but non-concentric with the housing, such that a centerline defined through the valve seat and the valve element is offset from a central axis of the housing. The valve element is linearly actuatable relative to the housing between a closed position in which the valve element engages the valve seat and blocks the bore and an open position in which the valve element permits flow of fluid therethrough.

18 Claims, 6 Drawing Sheets

BACK PRESSURE VALVE

CROSS-REFERENCE TO RELATED APPLICATIONS

This application claims priority to U.S. Provisional Patent Application Ser. No. 62/944,431, which was filed on Dec. 6, 2019, and is incorporated by reference in its entirety herein.

BACKGROUND

In oil and gas wells, tubular strings such as casing string, liner strings, etc., are run into a well and may be cemented in place to support production. Further, other types of tubular strings may be run into the well, e.g., within and through the cemented strings, to perform operations within the well. In various applications, either type of string may include a one-way check valve, often referred to as a "back pressure" valve. Back pressure valves allow circulation of fluid, cement, etc., in one direction, generally a downhole direction, through the string, but prevent reverse fluid flow, e.g., back up through the string to the surface.

Typically, back pressure valves use a flapper valve that pivots open and closed. The advantage of a flapper valve is that it can permit actuation of tools below the valve, e.g., via a drop ball pumped through the flapper valve. However, flapper valves generally include a relatively small spring-loaded hinge arrangement to achieve the desired one-way flow. Due to cyclic loading in the workstring, the hinge wears out quickly.

SUMMARY

Embodiments of the disclosure include a valve assembly for use in a wellbore includes a housing defining a bore that extends axially therethrough, a valve seat positioned in the housing, and a valve element movably positioned in the housing. The valve seat and the valve element are concentric to one another, but non-concentric with the housing, such that a centerline defined through the valve seat and the valve element is offset from a central axis of the housing. The valve element is linearly actuatable relative to the housing between a closed position in which the valve element engages the valve seat and blocks the bore and an open position in which the valve element permits flow of fluid therethrough.

Embodiments of the disclosure also include a method that includes positioning a valve seat in a first bore portion of a housing of a valve assembly, positioning a valve element in a second bore portion of the housing, the second bore portion having a larger radial dimension than the first bore portion. The first and second bore portions are radially offset. The method also includes linearly actuating the valve element from a closed position in which the valve element blocks fluid flow through the housing in at least one direction to an open position in which the valve element is spaced axially apart from the valve seat.

Embodiments of the disclosure further include a downhole valve. The valve includes a top sub including an upper connection for connecting to a superposed tubular of a workstring, a first valve assembly coupled to the top sub, a second valve assembly coupled to the first valve assembly, and a bottom sub coupled to the second valve assembly and including a lower connection for connecting to a subjacent tubular of the workstring. The top sub, first valve, second valve assembly, and the bottom sub cooperatively define at least a portion of a bore extending axially therethrough. The first valve assembly includes a housing coupled to the top sub and the spacer sub, and a module including a valve seat and a valve element, the module being non-concentrically disposed within the housing, such that a centerline defined through the valve seat and the valve element is offset from a central axis of the housing. The valve element is linearly actuatable between a closed position in which the valve element engages the valve seat and blocks the bore and an open position in which the valve element permits flow of fluid therethrough.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
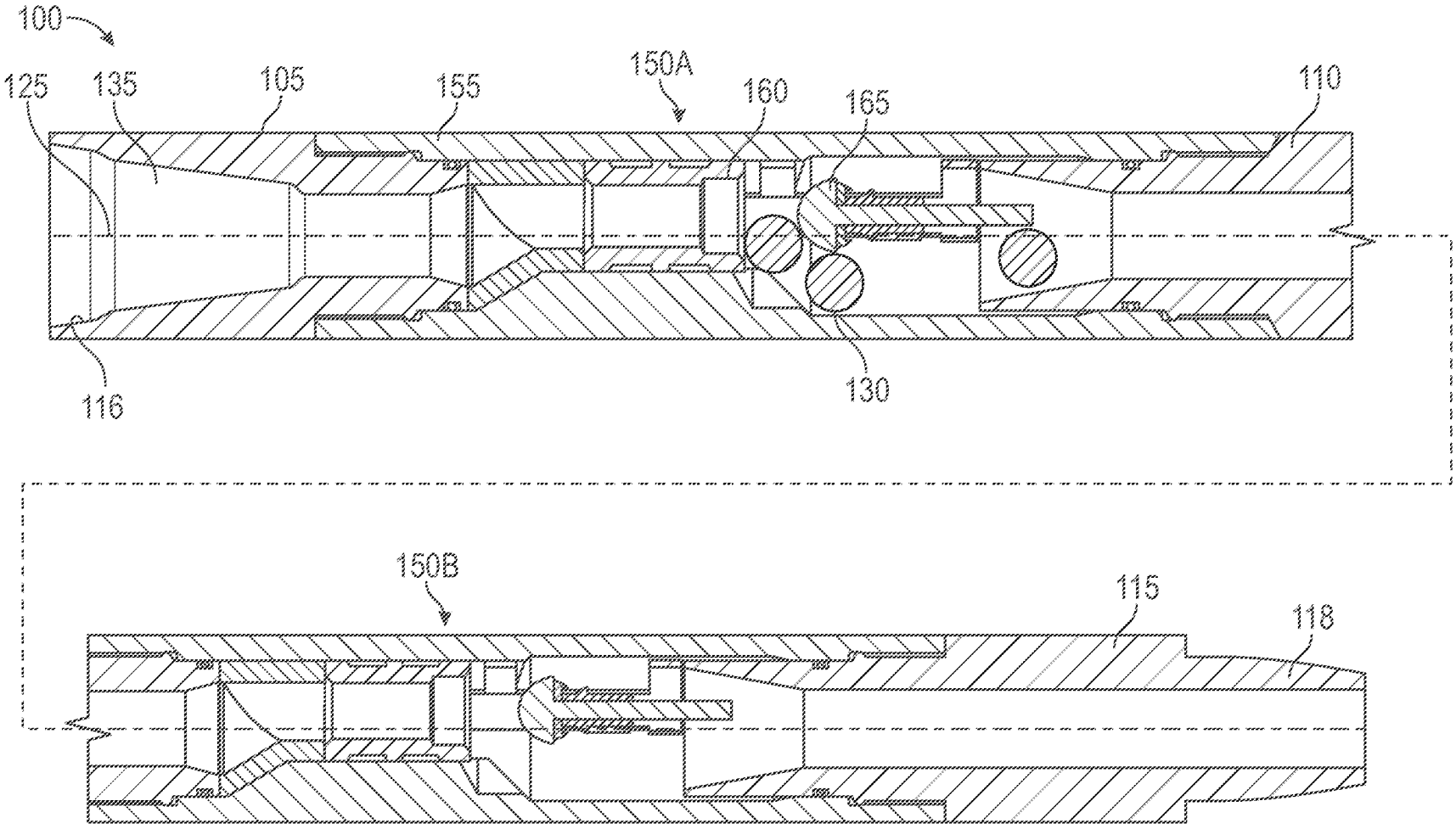
FIG. 1 illustrates a cross-sectional view of a downhole valve, including two valve assemblies, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a downhole valve 100, according to an embodiment. The downhole valve 100 may include a top sub 105, a spacer sub 110, and a bottom sub 115. The top sub 105 may have a threaded, female box end 116 for connection to a pin-end of a superposed tubular of a workstring (not shown). The bottom sub 115 may include a male, pin-end connection 118 for connection to a subjacent tubular of the workstring (not shown). Further, the valve 100 may include a bore 135 extending axially therethrough, e.g., cooperatively through the top sub 105, the spacer sub 110, and the bottom sub 115, as well as through any intermediate components. The individual subs 105, 110, 115 may each be formed from an integral, single-piece, generally-cylindrical member, but in other embodiments, may each include two or more individual pieces that are connected (e.g., threaded) together. In some other embodiments, one or more of the top sub 105, spacer sub 110, and/or bottom sub 115 may be omitted.

The downhole valve 100 may further include one or more valve assemblies (two shown: 150A, 150B). The valve assembly 150A, for example, is axially between and connects together the top sub 105 and the spacer sub 110, and the valve assembly 150B is axially between and connects together the spacer sub 110 and the bottom sub 115. Although two valve assemblies 150A, 150B are shown in FIG. 1, a single valve assembly 150 or any number of multiple valve assemblies 150 may be used in the downhole valve 100. As will be described in greater detail below, the valve assemblies 150A, 150B may redundantly operate to permit fluid flow in one axial direction through the bore 135, e.g., a downhole direction (toward the right in FIG. 1), block fluid flow in the opposite axial direction through the bore 135, e.g., an uphold direction (toward the left in FIG. 1), and permit passage of obstructing members (e.g., balls) 130 through the bore 135 and to one or more subjacent devices in the workstring.

Additional details will now be described for the valve assembly 150A, with it being appreciated that the valve assembly 150B may include the same or similar components and operate in the same or a similar manner. In particular, in the illustrated embodiment, the valve assembly 150A generally includes a cylindrical housing 155 that connects together the adjacent subs (in this case, the top sub 105 and the spacer sub 110) and defines a portion of the bore 135 therethrough. The valve assembly 150A further includes a valve seat 160 and a valve element 165 (e.g., a plunger) that are located within the housing 155. The valve element 165 is linearly movable in a direction parallel to a central longitudinal axis 125 of the valve 100, with respect to the housing 155 and the valve seat 160, between a closed position and an open position. In at least some embodiments, the valve element 165 is not pivotal between open and closed. When the valve element 165 is in the closed position, the valve element 165 engages the valve seat 160 and prevents fluid flow through the bore 135. When the valve element 165 is in the open position, the valve element 165 is separated axially apart from the valve seat 160, permitting fluid flow in the bore 135.

Furthermore, the valve seat 160 and the valve closure element 165 may be concentric to one another, and both eccentrically positioned within and with respect to the housing 155. For example, the housing 155 may be centered on the central axis 125. The centerline of the valve seat 160 and the valve closure element 165 may, by contrast, be radially offset (i.e., not collinear) with the central axis 125. This eccentric positioning may provide additional space for passage of the obstructing member(s) 130, as will be described in greater detail below.

Figure 2:
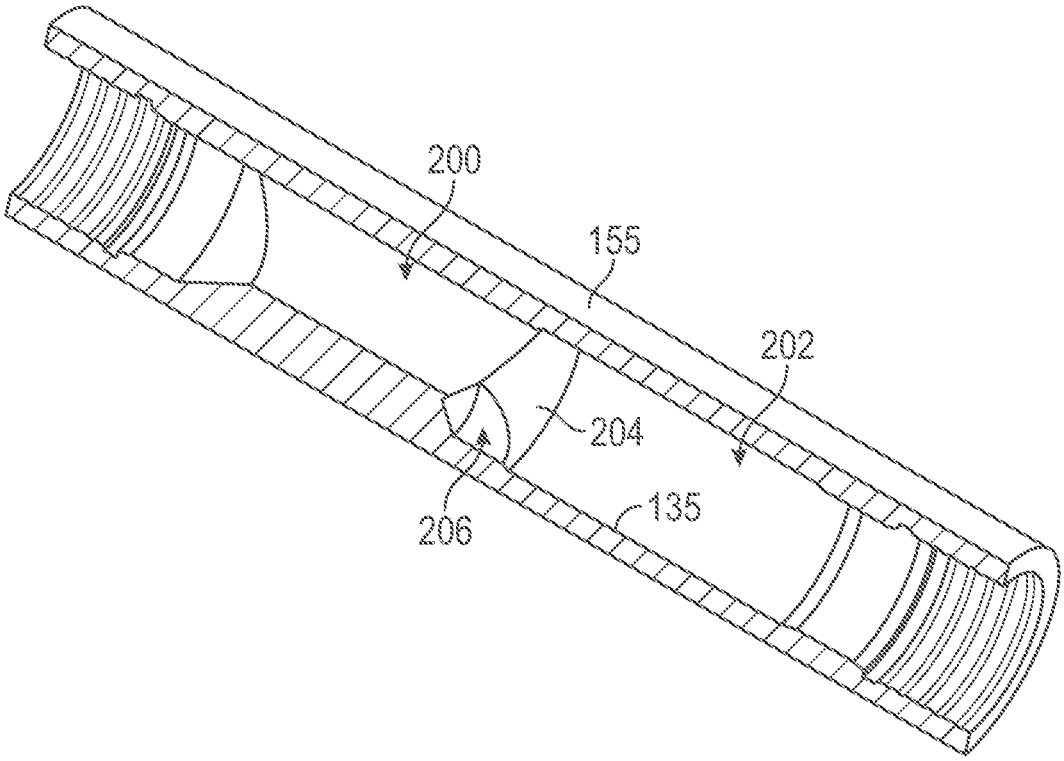
FIG. 2 illustrates a perspective, sectional view of a housing for one of the valve assemblies, according to an embodiment.

FIG. 2 illustrates a perspective, sectional view of the housing 155 of the valve assembly 150A, according to an embodiment. As shown, the housing 155 includes a first bore portion 200 and a second bore portion 202, each of which define part of the bore 135 that extends through the valve assembly 150A. The first bore portion 200 may be configured to receive the valve seat 160 (FIG. 1) and the second bore portion 202 may be configured to receive the valve element 165.

As an example, the first bore portion 200 is smaller in radial dimension than the second bore portion 202. Further, the first bore portion 200 is radially offset from the second bore portion 202; thus, while both portions 200, 202 may define generally cylindrical passages, the centers thereof are not radially aligned (e.g., as viewed in a direction parallel to the central axis 125 of FIG. 1). Further, a shoulder 204 may be defined in the housing 155, e.g., where the inner surface of the housing 155 transitions from the first bore portion 200 to the second bore portion 202 (e.g., accounting for the different radial positioning and dimension). A cutout 206 may be formed in the shoulder 204, which may provide additional area for the obstructing member 130 (FIG. 1) to proceed through the valve assembly 150A, as will be described in greater detail below.

Figure 3:
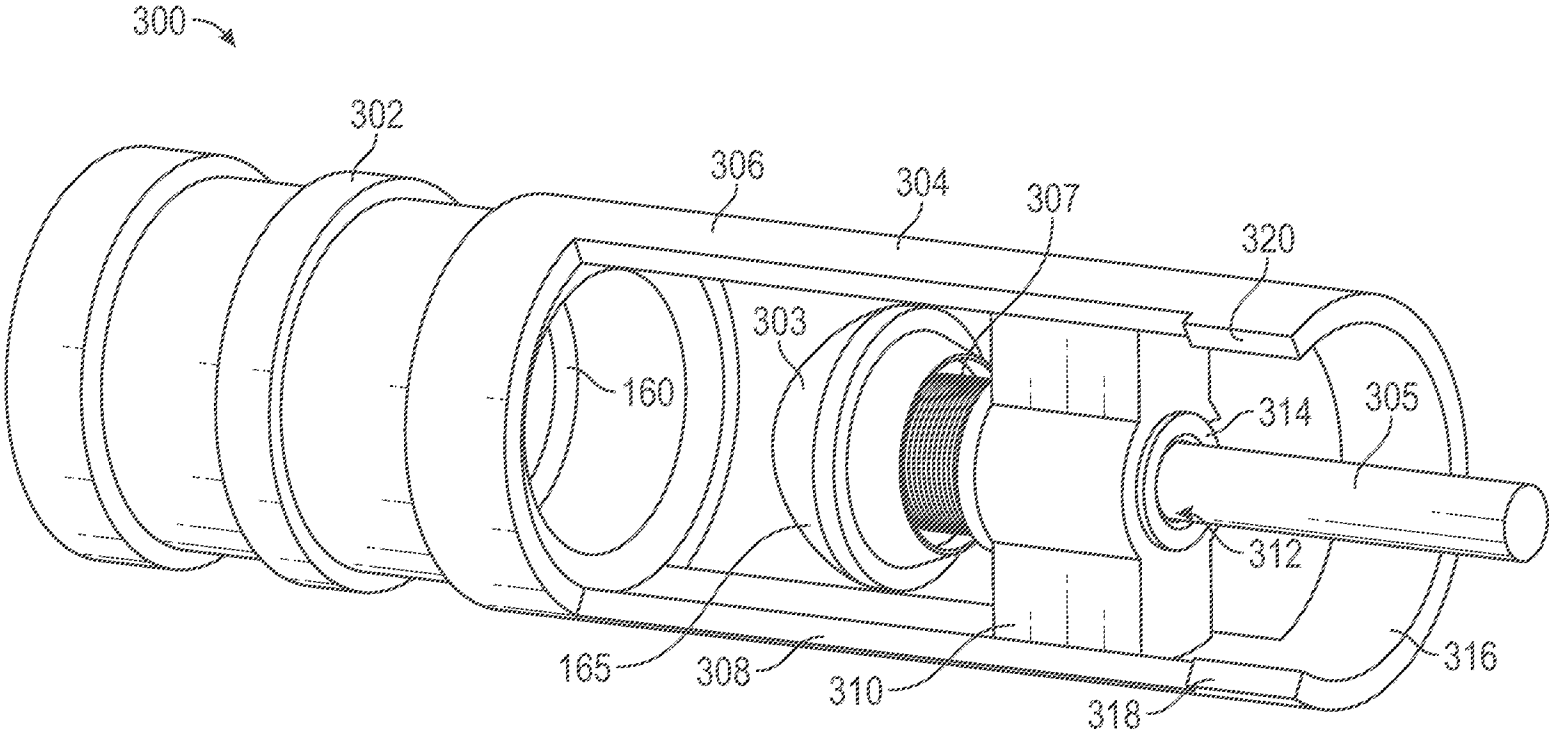
FIG. 3 illustrates a perspective view of a module for one of the valve assemblies, with the module including a valve element in an open position, according to an embodiment.

FIG. 3 illustrates a perspective view of a module 300 that provides the valve seat 160 and the valve element 165, according to an embodiment. In this view, the valve element 165 is separated axially apart from the valve seat 160, corresponding to the open position of the valve element 165. The module 300 may include a sleeve 302, which may provide the valve seat 160 proximal to an open end thereof. The sleeve 302 may be configured to be received into the first bore portion 200 (FIG. 2) of the housing 155, e.g., such that the outer surface of the sleeve 302 seals with the inner surface of the first bore portion 200. Further, the sleeve 302 may be concentrically positioned with and at least partially within in the first bore portion 200.

The valve element 165 includes an enlarged, seat-engaging portion 303 and a post 305 extending therefrom. The seat-engaging portion 303 may be conical or, as shown, partially spherical to provide an effective, e.g., sealing, engagement with the valve seat 160. A biasing member 307, such as a helical spring, is received around the post 305 and biases the valve element 165 in an axial direction toward the valve seat 160.

The module 300 may further include an element retainer 304. The element retainer 304 may be integral (formed as a single piece) with the sleeve 302, but in other embodiments, may be separately formed and connected thereto. The element retainer 304 may include one or more (e.g., a pair of) axial supports 306, 308, which may be separated circumferentially, for example, by about 180 degrees. In other embodiments, other angular separations may be employed. The axial supports 306, 308 may extend past the seat-engaging portion 303 of the valve element 165, and thus may position the valve element 165 at least partially therebetween.

The element retainer 304 may also include a central support 310. The central support 310 may extend between the two axial supports 306, 308. The central support 310 may define a hole 312 therein. The hole 312 may be aligned with the center of the sleeve 302, and may include a bushing 314 at least partially therein. The post 305 of the valve element 165 may be received through the hole 312 and the bushing 314, and may be linearly movable therein. For example, the biasing member 307 may be retained axially between the seat-engaging portion 303 and the bushing 314 and/or the central support 310. In an embodiment, the hole 312 may be open on one lateral side, opposite to the view of the central support 310 shown in FIG. 5, so as to permit the bushing 314 and the post 305 to be received laterally into the central support 310. The central support 310 may thus provide an end range for movement of the seat-engaging portion 303 away from the valve seat 160, as the enlarged, seat-engaging portion 303 may be too large to fit through the hole 312. In some embodiments, the bushing 314 may include an annular end ring that is interposed between the seat-engaging portion 303 and the central support 310.

The element retainer 304 further includes an arcuate end support 316 that defines two circumferentially-facing ends 318, 320. The area between the circumferential ends 318, 320 may be empty, representing a cutout from what might otherwise be an arcuate shape. The arcuate end support 316 may be cutaway (or otherwise arcuate, rather than annular) in order to facilitate passage of the obstructing member 130. The ends 318, 320 may be separated by an angle that is smaller than the angle separating the axial supports 306, 308, and the axial supports 306, 308 may be connected to or integrally formed with the arcuate end support 316 and/or the central support 310.

Figure 4:
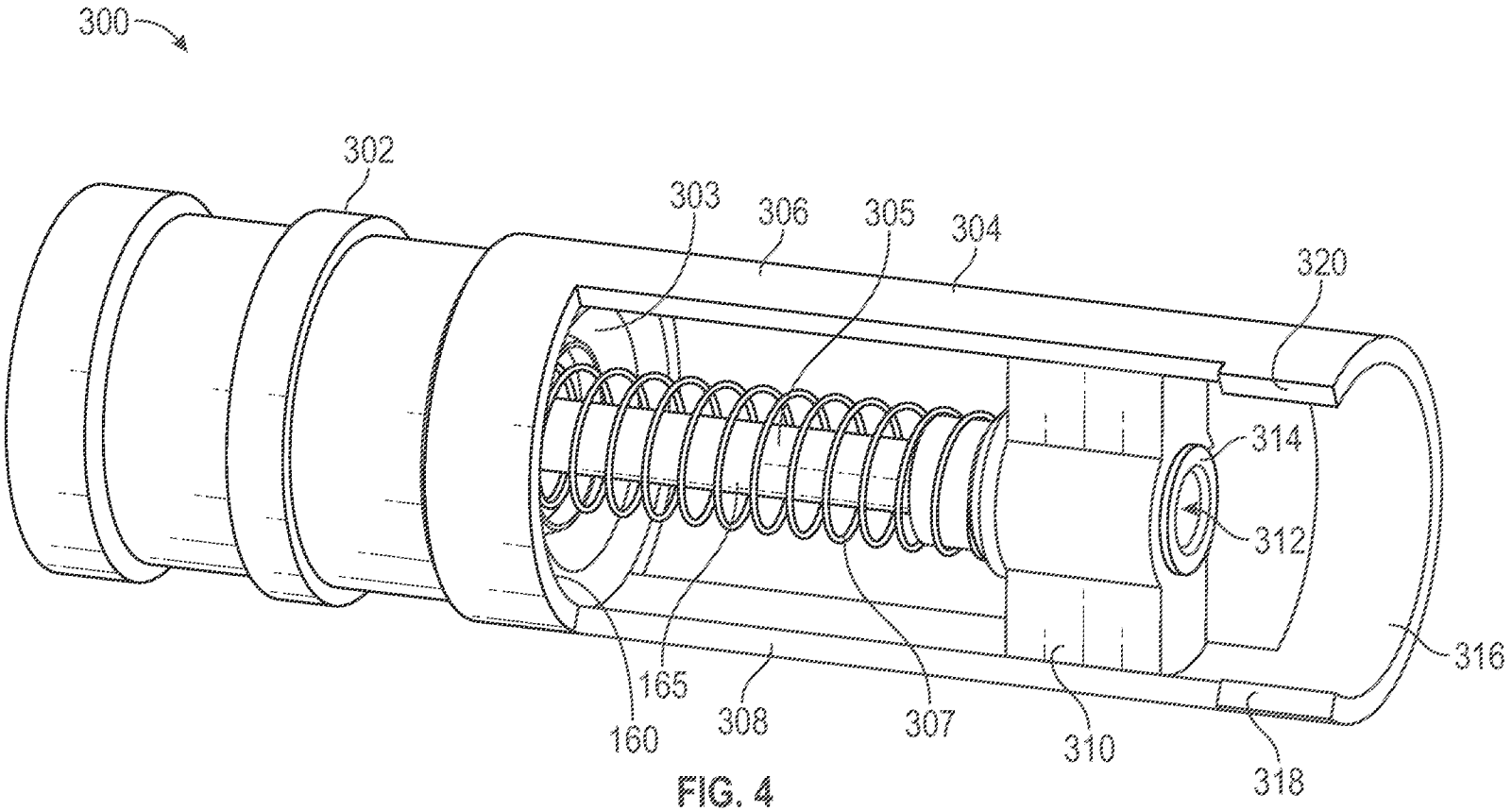
FIG. 4 illustrates a perspective view of the module with the valve element thereof in a closed position, according to an embodiment.

FIG. 4 illustrates a perspective view of the module 300, with the valve element 165 received partially into the sleeve 302 and engaging the valve seat 160, according to an embodiment. Accordingly, the configuration of FIG. 4 may correspond to the valve element 165 in a closed position. As shown, the biasing member 307 (e.g., spring) has pressed the seat-engaging portion 303 linearly away from the central support 310, and into engagement with the valve seat 160. As such, fluid flow in an axial direction from the central support 310 toward the sleeve 302 (e.g., uphole) is blocked. Because of the biasing force supplied by the biasing member 307, uphole fluid flow may not be required to cause the valve element 165 to close against the valve seat 160, and thus the valve element 165 may "default" to the closed position in the absence of fluid flow pressing the valve element 165 away from the valve seat 160. On the other hand, fluid flow in the opposite direction (e.g., downhole), once the pressure thereof applies a force on the valve element 165 that exceeds the biasing force applied by the biasing member, causes the valve element 165 to move linearly away from the valve seat 160, toward the central support 310, thereby permitting the fluid to flow past.

Figure 5:
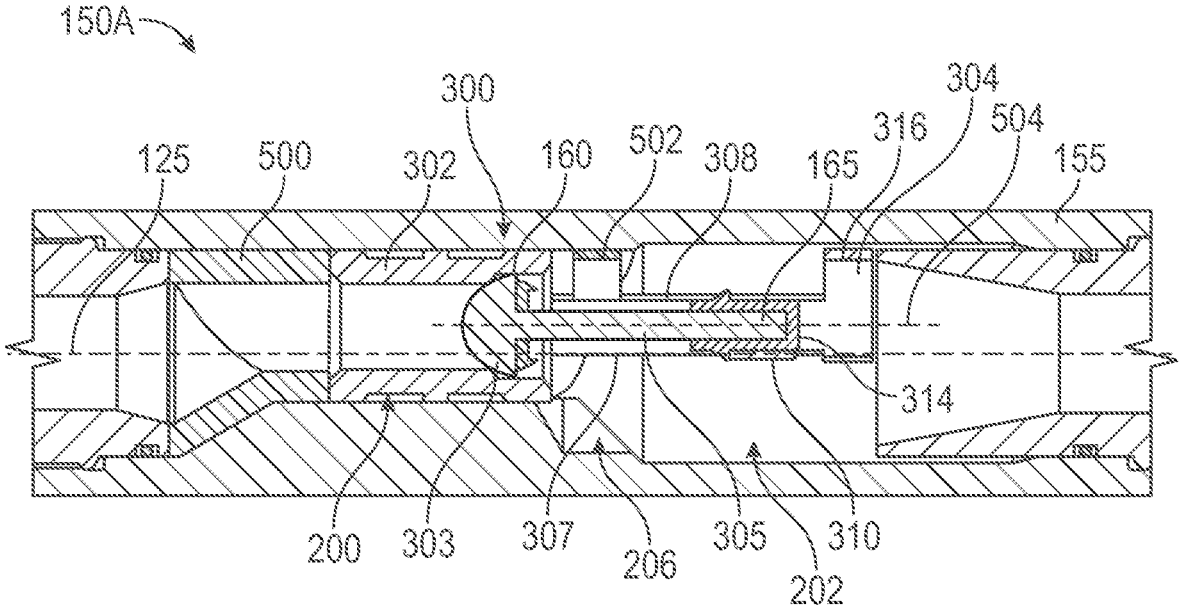
FIG. 5 illustrates a cross-sectional view of one of the valve assemblies, with the valve element thereof in a closed position, according to an embodiment.
Figure 6:
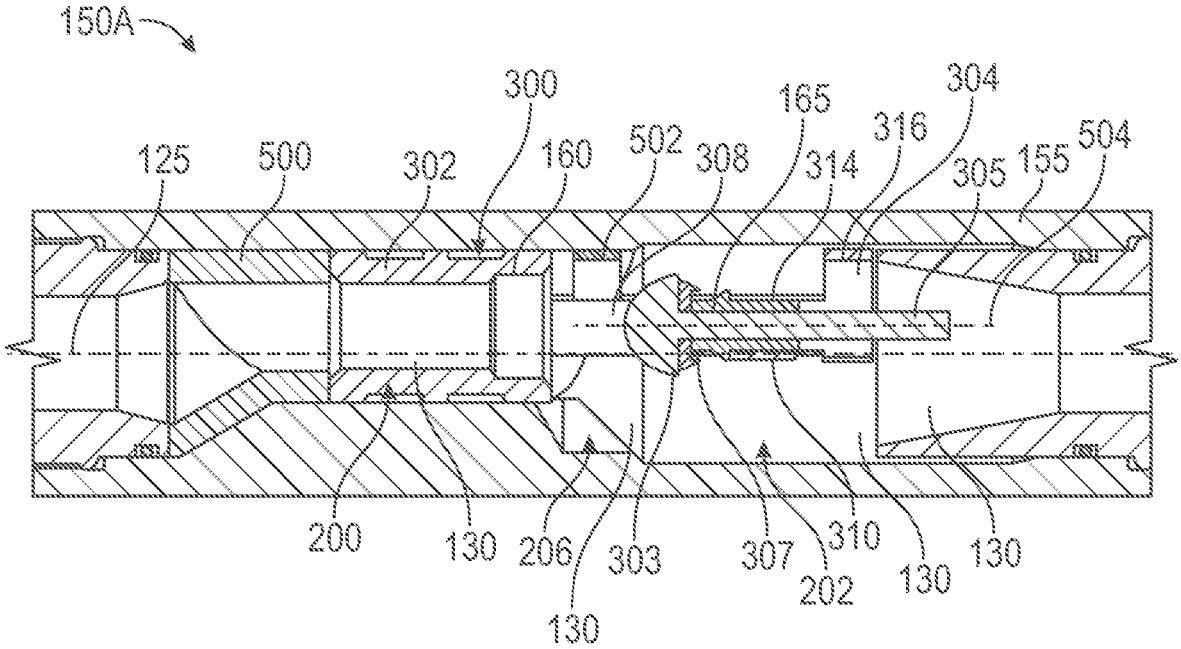
FIG. 6 illustrates a cross-sectional view of one of the valve assemblies, with the valve element thereof in an open position, permitting obstructing members to proceed therethrough, according to an embodiment.

FIGS. 5 and 6 illustrate a side, cross-sectional view of the valve assembly 150A, with the valve element 165 in a closed position and in an open position, respectively, according to an embodiment. Again, the valve assembly 150B (and/or any others provided in the downhole valve 100) may be the same or similar in structure and function. As shown, the module 300 is received within the housing 155. In particular, the sleeve 302 is received into the first bore portion 200, while the element retainer 304 supports the valve element 165 at least partially in the second, larger bore portion 202.

A spacer 500 may be provided in the first bore portion 200, as well, e.g., to position and retain the module 300 therein, e.g., prevent the module 300 from sliding in an uphole (left) direction. Further, an arcuate blocking member 502 may be positioned in the second bore portion 202. The arcuate blocking member 502 may extend in a circumferential direction between the axial supports 306, 308, around the valve element 165, so as to avoid impeding the linear, axial movement thereof. The blocking member 502 may serve to prevent the obstructing members 130 from becoming entrained between the valve element 165 and the housing 155, instead directing them away from the blocking member 502, and around the "bottom" (as shown) of the valve element 165.

As shown in FIG. 5, in the closed position, the valve element 165 is pressed toward the sleeve 302, such that the seat-engaging portion 303 engages the valve seat 160, thereby preventing (uphole) flow. As shown in FIG. 6, in the open position, the valve element 165 is pressed away from the sleeve 302, such that the seat-engaging portion 303 is pressed toward the central support 310. As such, the seat-engaging portion 303 is separated axially apart from the seat 160.

The obstructing members 130 (several are shown to illustrate movement thereof) may thus be received through the valve assembly 150A. For example, the obstructing members 130 may proceed into the housing 155 and into the first bore portion 200. In the first bore portion 200, the obstructing members 130 may proceed through the sleeve 302. Once out of the sleeve 302, the obstructing members 130 may proceed between the seat-engaging portion 303 and the valve seat 160, and then along the shoulder 204 (e.g., in the cutout 206) so as fit past the seat-engaging portion 303 and the rest of the valve element 165 and element retainer 304 in the second bore portion 202. The obstructing members 130 may then proceed down through the remainder of the bore 135, out through the end 118 of the bottom sub 115 (FIG. 1) and continue into the workstring to actuate, block, or perform other functions in cooperation with other devices of the workstring.

Accordingly, it will be seen from FIGS. 5 and 6 that positioning the module 300 in a radially offset position, such that a centerline 504 of the valve seat 160 and valve element 165 is offset radially from the central axis 125 of the housing 155 (and the second bore portion 202), may provide additional radial area between the valve element 165 and part of the second bore portion 202 of the housing 155. This may permit a larger obstructing member 130 to be used than would be permissible if the valve assembly 150A components were concentrically aligned. For example, in at least some embodiments, the valve element 165 being offset, e.g., toward one point along the inner surface of the housing 155, may result in the radial space available to pass the obstructing member 130 approaching a difference in the diameters of the valve element 165 and the second bore portion 202, rather than the difference between their radii (as would be the case if they were concentric). As such, the obstructing member 130 may have a cross-sectional dimension (e.g., diameter) that exceeds a difference between the radii of the second bore portion 202 and the seat-engaging portion 303 of the valve element 165 (but less than a difference between the diameters thereof). Further, the provision of the cutout 206 in the shoulder 204 and the cutaway of the arcuate end support 320 of the element retainer 304 may permit the obstructing member 130 to have a cross-sectional dimension that exceeds a difference between the diameters of the first bore portion the second bore portion, because the smallest radial passage is defined around the seat-engaging member 303, which is smaller than the outer diameter of the sleeve 302 that fits into the first bore portion 200.

In other embodiments, however, the module 300 could be positioned concentrically within the housing 155. In such an embodiment, smaller obstructing members 130 may be used. another embodiment, the valve assembly 145 is disposed in the body of the valve cartridge. Such smaller obstructing members may be used in combination with a baffle (not shown) to actuate a subjacent tool.

The valve assembly 150A may be cycled many times between the opened position and the closed position with a low failure rate as compared to the conventional back pressure valve that uses a flapper valve which pivots around a hinge with a spring. Further, the configuration of the valve assembly 150A providing linear actuation (it will be appreciated that linear actuation may permit for some incidental rotation of the valve element 165 on its axis) may permit pumping at higher rates and using harder-hitting agitators to get farther into lateral wellbores with coil tubing and/or the ability to drill through plugs faster.

Figure 7:
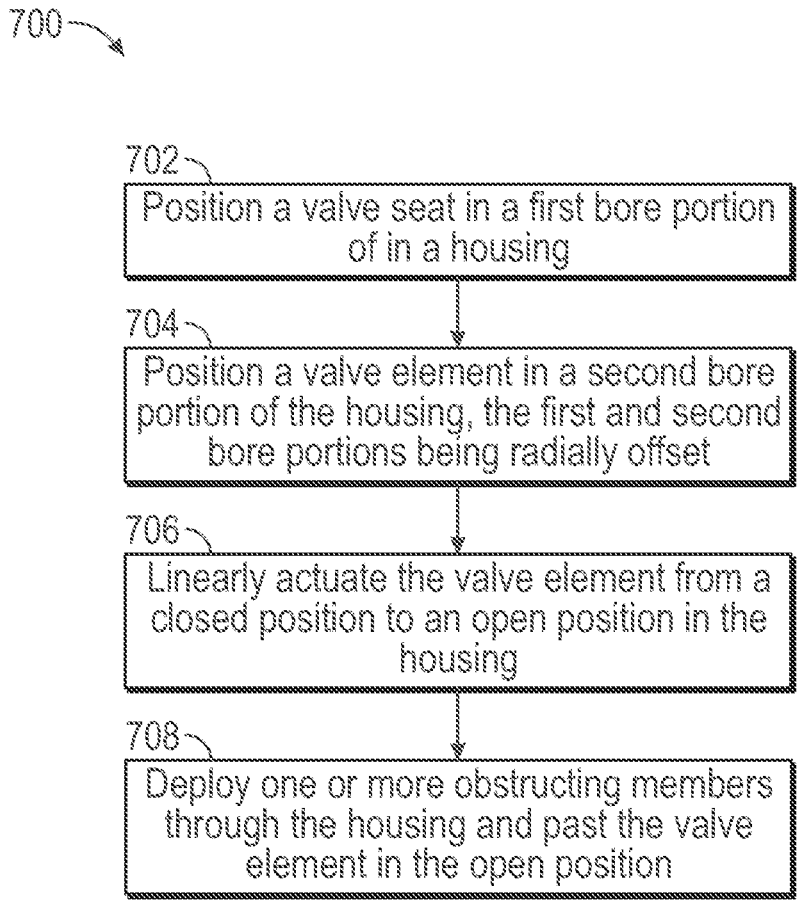
FIG. 7 illustrates a flowchart of a method for operating a downhole valve, according to an embodiment.

FIG. 7 illustrates a flowchart of a method 700 for operating a downhole valve, such as the downhole valve 100 discussed and described above, according to an embodiment. At least some embodiments of the method 700 may employ other valves, and thus the method 700 should not be limited to any particular structure unless otherwise provided herein. Further, aspects of the method 700 may be performed in the order presented herein, or in any other order; moreover, aspects of the method 700 may be combined, separated, performed simultaneously or in parallel, without departing from the scope of the present disclosure.

The method 700 may include positioning a valve seat in a first bore portion of a valve housing, as at 702. For example, as shown in FIGS. 5 and 6, the valve seat 160, as part of the module 300, may be positioned (e.g., slid) into the first bore portion 200 of the housing 155.

The method 700 may further include positioning a valve element in a second bore portion of the housing, the first and second bore portions being radially offset, as at 704. Still referring to FIGS. 5 and 6, the valve element 165, e.g., as supported by the element retainer 304 (shown in greater detail in FIGS. 3 and 4), may be positioned in the second bore portion 202. As described above, the second bore portion 202 may have a larger internal diameter than the first bore portion 200. Further, the first and second bore portions 200, 202 may be non-concentric, i.e., radially offset from one another. In a specific embodiment, the first bore portion 200 may be radially offset from the central axis 125 of the housing 155, while the second bore portion 202 may be concentric with the central axis 125. Further, in this arrangement, the valve seat 160 may be concentric with the first bore portion 200, and thus eccentric to the housing 155. The valve element 165 may likewise be concentric to the first bore portion 200, and thus eccentric to the housing 155 (and the second bore portion 202 in which the valve element 165 is positioned).

The method 700 may include linearly actuating the valve element from a closed position to an open position in the housing, as at 706. This may be done at least partially based on fluid flow, e.g., with fluid flow in a downhole direction serving to move the valve element linearly to the open position and reverse flow and/or a biasing force serving to move the valve element linearly to the closed position. This is again illustrated, by way of example, in FIGS. 5 and 6. There it is shown that the valve element 165 is actuated linearly between the closed position (FIG. 5) and the open position (FIG. 6). As such, the valve assembly 150A may serve to prevent reverse flow (uphole) without requiring reverse fluid flow to force the valve assembly 150A closed.

Before, during, or after actuating at 706, the method 700 may include deploying one or more obstructing members through the housing and past the valve element in the open position, as at 708. For example, as specifically shown in FIG. 6, the obstructing members 130, which may be too large to fit between the valve element 165 and the housing 155 if the valve element 165 were concentrically disposed within the housing 155, are pumped down into housing 155, through the first bore portion 200, the sleeve 302, the valve seat 160, the second bore portion 202, and around and past the valve element 165 and ultimately out through the bore 135 at the lower end 118 (FIG. 1).

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A valve assembly for use in a wellbore, the valve assembly comprising:

a housing defining a bore that extends axially therethrough;

a valve seat positioned in the housing; and a valve element movably positioned in the housing, wherein the valve seat and the valve element are concentric to one another, but non-concentric with the housing, such that a centerline defined through the valve seat and the valve element is offset from a central axis of the housing, wherein the valve element is linearly actuatable relative to the housing between a closed position in which the valve element engages the valve seat and blocks the bore and an open position in which the valve element permits flow of fluid therethrough, and wherein the valve element in the open position is configured to permit an obstructing member to move through the valve seat and around the valve element.

2. The valve assembly of claim 1, further comprising a biasing member configured to press the valve element toward the valve seat, such that the valve element moves to the closed position in the absence of fluid flow in a first axial direction, and wherein the valve element in the closed position prevents fluid flow in a second axial direction.

3. A valve assembly for use in a wellbore, the valve assembly comprising:

a housing defining a bore that extends axially therethrough;

a valve seat positioned in the housing; and a valve element movably positioned in the housing, wherein the valve seat and the valve element are concentric to one another, but non-concentric with the housing, such that a centerline defined through the valve seat and the valve element is offset from a central axis of the housing, wherein the valve element is linearly actuatable relative to the housing between a closed position in which the valve element engages the valve seat and blocks the bore and an open position in which the valve element permits flow of fluid therethrough, and wherein the bore comprises a first bore portion and a second bore portion, the first bore portion being smaller in radial dimension than the second bore portion and radially offset therefrom, the valve seat being disposed in the first bore portion and the valve element being disposed at least partially in the second bore portion.

4. The valve assembly of claim 3, wherein the valve element in the open position is configured to permit an obstructing member to move through the valve seat and around the valve element, the obstructing member having a cross-sectional dimension that is greater than a difference between a radius of the valve seat and a radius of the second bore portion.

5. The valve assembly of claim 3, further comprising:

a sleeve providing the valve seat, wherein the sleeve is received at least partially in the first bore portion, is concentric therewith, and eccentric to the second bore portion; and an element retainer coupled to or integral with the sleeve and extending therefrom at least partially in the second bore portion, wherein the valve element is slidably secured to the element retainer.

6. The valve assembly of claim 5, wherein the valve element comprises:

a seat-engaging portion that engages the valve seat when the valve element is in the closed position; and a post extending from the seat-engaging portion and movably received into the element retainer, wherein, when the valve element is in the closed position, the element retainer prevents the seat-engaging portion from further movement away from the valve seat.

7. The valve assembly of claim 6, further comprising a biasing member received between the seat-engaging portion and the element retainer.

8. The valve assembly of claim 6, wherein the element retainer includes a sleeve that provides the valve seat, a pair of axially-extending supports extending from the sleeve, a central support through which the post is received, and an arcuate end-support coupled to pair of axially-extending supports.

9. The valve assembly of claim 8, wherein the arcuate end-support comprises two circumferentially facing end surfaces defining a cutout out region therebetween.

10. The valve assembly of claim 3, wherein the housing comprises a shoulder defining a transition between the first and second bore portions, the shoulder defining a cutout therein for receiving an obstructing member.

11. A valve assembly for use in a wellbore, the valve assembly comprising:

a housing defining a bore that extends axially therethrough;

a valve seat positioned in the housing;

a valve element movably positioned in the housing, wherein the valve seat and the valve element are concentric to one another, but non-concentric with the housing, such that a centerline defined through the valve seat and the valve element is offset from a central axis of the housing, and wherein the valve element is linearly actuatable relative to the housing between a closed position in which the valve element engages the valve seat and blocks the bore and an open position in which the valve element permits flow of fluid therethrough; and a blocking member configured to direct an obstructing member around the valve element when the valve element is in the open position.

12. A method comprising:

positioning a valve seat in a first bore portion of a housing of a valve assembly;

positioning a valve element in a second bore portion of the housing, the second bore portion having a larger radial dimension than the first bore portion, wherein the first and second bore portions are radially offset; and linearly actuating the valve element from a closed position in which the valve element blocks fluid flow through the housing in at least one direction to an open position in which the valve element is spaced axially apart from the valve seat, wherein linearly actuating the valve element comprises pumping fluid downhole through a workstring to which the valve assembly is connected, and wherein the valve element prevents reverse fluid flow in an uphole direction.

13. The method of claim 12, further comprising biasing the valve element toward the closed position, such that the valve assembly blocks fluid flow in at least one direction without requiring fluid flow to close the valve assembly.

14. A method comprising:

positioning a valve seat in a first bore portion of a housing of a valve assembly;

positioning a valve element in a second bore portion of the housing, the second bore portion having a larger radial dimension than the first bore portion, wherein the first and second bore portions are radially offset;

linearly actuating the valve element from a closed position in which the valve element blocks fluid flow through the housing in at least one direction to an open position in which the valve element is spaced axially apart from the valve seat; and deploying one or more obstructing members through the housing when the valve element is in the open position.

15. The method of claim 14, wherein the one or more obstructing members have a cross-sectional dimension that is greater than a difference in radii between a seat-engaging portion of the valve element and the second bore portion.

16. A downhole valve, comprising:

a top sub comprising an upper connection for connecting to a superposed tubular of a workstring;

a first valve assembly coupled to the top sub;

a second valve assembly coupled to the first valve assembly; and a bottom sub coupled to the second valve assembly and comprising a lower connection for connecting to a subjacent tubular of the workstring, wherein:

the top sub, first valve, second valve assembly, and the bottom sub cooperatively define at least a portion of a bore extending axially therethrough, and the first valve assembly comprises:

a housing coupled to the top sub; and a module including a valve seat and a valve element, the module being non-concentrically disposed within the housing, such that a centerline defined through the valve seat and the valve element is offset from a central axis of the housing, wherein the valve element is linearly actuatable between a closed position in which the valve element engages the valve seat and blocks the bore and an open position in which the valve element permits flow of fluid therethrough.

17. The downhole valve of claim 16, wherein:

the bore extends through the housing in the first valve assembly;

in the housing, the bore has a first bore portion and a second bore portion, the first bore portion being smaller in radial dimension than the second bore portion and radially offset therefrom, the module being at least partially disposed in the first and second bore portions; and the valve element in the open position is configured to permit an obstructing member to move through the valve seat and around the valve element, the obstructing member having a cross-sectional dimension that is greater than a difference between a radius of the valve seat and a radius of the second bore portion.

18. The downhole valve of claim 16, further comprising a spacer sub between the bottom sub and the top sub, wherein the housing is coupled to the spacer sub and the top sub.

* * * * *